US007256691B2

(12) United States Patent
Awobue

(10) Patent No.: US 7,256,691 B2
(45) Date of Patent: Aug. 14, 2007

(54) SMART MAILBOX

(76) Inventor: Christopher Awobue, 103 S. Durand Pl., Irvington, NJ (US) 07111

( * ) Notice: Subject to any disclaimer, the term of this patent is extended or adjusted under 35 U.S.C. 154(b) by 209 days.

(21) Appl. No.: 11/112,315

(22) Filed: Apr. 25, 2005

(65) Prior Publication Data

US 2005/0253715 A1 Nov. 17, 2005

Related U.S. Application Data

(60) Provisional application No. 60/569,851, filed on May 12, 2004.

(51) Int. Cl.
*G08B 13/08* (2006.01)

(52) U.S. Cl. ..... 340/545.6; 340/569; 232/17; 232/34

(58) Field of Classification Search ..... 340/545.6, 340/569; 232/17, 34
See application file for complete search history.

(56) References Cited

U.S. PATENT DOCUMENTS 5,774,053 A * 6/1998 Porter ..... 340/568.1
5,845,843 A * 12/1998 Kuller ..... 232/38
5,850,967 A * 12/1998 White ..... 232/17
5,917,411 A * 6/1999 Baggarly ..... 340/569
5,950,919 A * 9/1999 Adams ..... 232/34
6,987,452 B2 * 1/2006 Yang ..... 340/569
7,123,147 B2 * 10/2006 Engel ..... 340/545.6
2003/0231112 A1 * 12/2003 Raju ..... 340/569
2005/0122220 A1 * 6/2005 Staples ..... 340/569

* cited by examiner

*Primary Examiner*—Jeffery Hofsass
*Assistant Examiner*—Samuel Walk
(74) *Attorney, Agent, or Firm*—Paul R. Gauer

(57) ABSTRACT

A smart mailbox having a receptacle with a front panel door and a postal slot comprising; means for detecting receipt of a mail; an indicator connected to said detector for indicating receipt of a mail, and; means for electronically locking the mailbox thus providing a secure and smart mailbox. The means for detecting includes motion detectors or weight detectors or both and indicator includes a local and a remote indicator. Further said means for electronically locking may be an electromagnetically operated lock and a keypad. In addition the keypad may include a remote keypad for remote operations of the remote keypad and the remote indicator the mailbox provides a transceiver.

8 Claims, 3 Drawing Sheets

SMART MAILBOX

This appln claims benefit of 60/569,851 May 12, 2004.

FIELD OF INVENTION

The present invention relates to a mailbox. More particularly to a smart mailbox having audio or visual or both indicators to indicate receipt of the mail, and a locking system for securing received mail.

BACKGROUND OF INVENTION

The conventional mailbox, well known in the art, comprises a receptacle with a locking mechanism for receiving the mail, remains susceptible to thefts and other intrusions. Further, to identify if any mail is received, it is frequently required to reach and check manually into the mailbox. Similar to mechanical locks, the loss of keys or losing the lock combination often requires replacing the lock, which results in unnecessary expenses and waste. Also the security of the mailbox becomes again a matter of concern when the mailbox has a number lock, and tenants or the owners of the house change because the old residents will now have access to the new residents' mail. These and many other problems have been long identified. Different solutions to the problems have been tried. However there exists no comprehensive solution to all the above problems.

Accordingly there exists a need of a smart mailbox that not only indicates receipt of mail but also has options for an electronic and mechanical locking system.

Therefore the object of the invention obviate above and other drawbacks from the prior art.

The object of the invention is to provide a smart mail box that not only indicates receipt of mail but also has options for an electronic and mechanical locking system.

Yet another object of the invention is to provide one or more indicators, such as with red and green indicator lights illuminating interchangeably between the empty mailbox and a mailbox containing mail.

A further object of the invention is to provide one or more remote or local audio alarms with the mail box to indicate receipt of mail.

To achieve above and other objects, the present invention provides a smart mailbox having a receptacle with a front panel door and a postal slot comprising; one or more detectors to detect a receipt of a mail, an indicator connected to said detector for indicating receipt of a mail, and means for electronically locking the mailbox thus providing a secure and smart mailbox. The detectors may include motion and weight detectors and indicator may include a local and a remote indicator. Further means for electronically locking is an electromagnetically operated lock and a keypad. The keypad includes remote keypad also. The mailbox is provided with a transceiver for remotely operating the electronic lock and remote indicators.

The invention further provides a method for securing and receiving mail in a mailbox comprising steps of; providing means for electronically locking the mailbox thereby securing mail received in the mailbox, detecting receipt of a mail in the mailbox, and; indicating receipt of a mail. The step of providing means for electronically locking includes step of providing an electromagnetically operated lock and a keypad and said keypad includes remote keypad. Further step of indicating includes step of indicating receipt of a mail at a local and at remote locations. The step of providing remote keypad and step of remote indication uses a transceiver for remote operations. In addition step of detecting receipt of a mail step of detecting motion or weight or both of the dropped mail in the box.

SUMMARY

An aspect of this invention is a smart mailbox for receiving mail, comprising: a base, a plurality of side walls secured to said base extending upwardly therefrom, a front panel mechanically attached to said base also extending upwardly from said base, said front panel having a front panel door and having a postal slot; an upper lid secured to said side walls and said front panel; said base, said plurality of walls, said front panel, and said upper lid defining a receptacle therein; a sensor configured internally within said receptacle for detecting receipt of a mail; an indicator placed on said front panel door, connected to said sensor for indicating receipt of a mail; a first lock placed on said front panel door configured for locking and unlocking said front panel door to said front panel of said receptacle; a second lock placed on said upper lid configured for locking and unlocking said upper lid to said front panel; and a keypad mounted on said receptacle connected to said first lock for operating locking and unlocking of said front panel door.

Another aspect is a method for securing and receiving mail in a mailbox comprising steps of: providing means for electronically locking the mailbox thereby securing mail received in the mailbox; detecting receipt of a mail in the mailbox; and indicating receipt of a mail.

Yet another aspect is a smart mailbox for indicating the receipt of a mail having an upper lid hingedly connected to a receptacle having a base, plurality of walls and a front panel door, said front panel door further having a postal slot for receiving mail into it, an indicator, a motion sensor placed inside said front panel door configured to detect the motion/receipt of a mail, a manual key lock for manually locking said front panel door, a weight sensor for sensing the weight of said received mail thereby indicating the presence/absence of a received mail through said indicator and an electronic locking system having an electromagnetic lock and a key pad for manually/remotely operating said key pad for locking said front panel door.

An aspect of this invention includes a smart mailbox having a receptacle with a front panel door and a postal slot, wherein the improvement comprises: a sensor for detecting receipt of mail; an indicator operably connected to said sensor for indicating receipt of a mail; a keypad operably connected to lock and unlock the front panel door; and an electronic lock.

Another aspect of this invention includes a method for securing and receiving mail in a mailbox comprising steps of: providing means for electronically locking the mailbox thereby securing mail received in the mailbox; detecting receipt of a mail in the mailbox; and indicating receipt of a mail.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

BRIEF DESCRIPTION OF THE PREFERRED EMBODIMENTS

Figure 1:
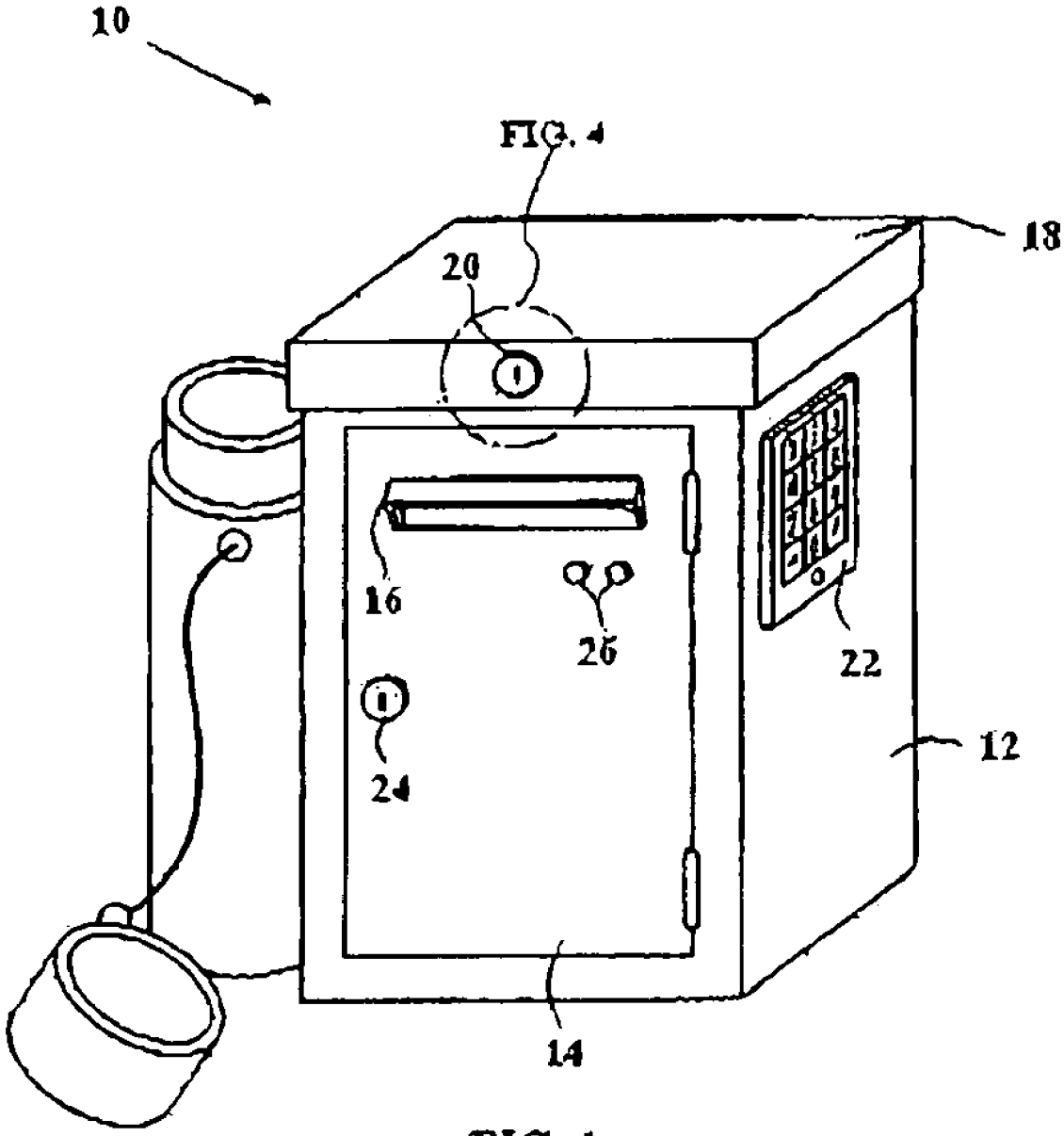
FIG. 1 shows a first pictorial view of the mailbox.

Referring to FIG. 1, a first view of the mailbox 10 is disclosed in accordance with the preferred embodiment of the invention. In the exemplary invention, the mailbox is essentially cubicle in shape. A mailbox is made of box 12 having a door 14 that is hingedly openable with respect to the box 12, defining an enclosure therein. The enclosure is also referred to as the receptacle. The door 14 has a postal slot 16 that is oriented substantially horizontal.

Figure 4:
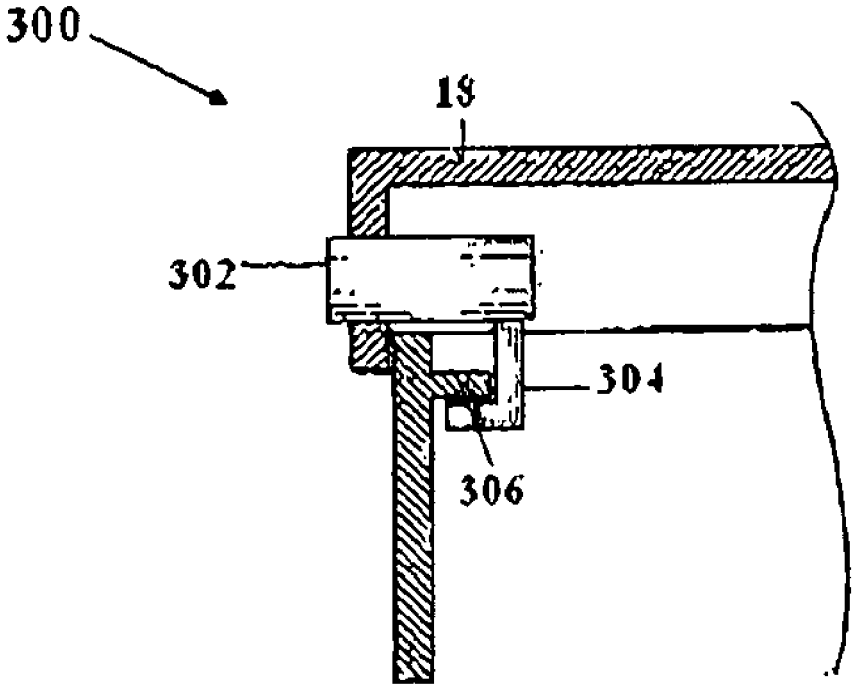
FIG. 4 shows a sectional view of an upper lock of mailbox.

The mailbox 10 is provided with an upper lid 18 movably attached through the hinges 102 (visible in FIG. 2) to the back panel of the mailbox. An upper keyhole 20 positioned on a front panel of the lid 18. A detailed diagram of the keyhole 20 and associated locking system is shown in FIG. 4. The mailbox further comprises a keypad 22 for electronically locking and opening the door, a front door keyhole 24 providing options for mechanically and electronically locking and opening door, and indicators 26 for indicating receipt of mail in the box 12.

Figure 2:
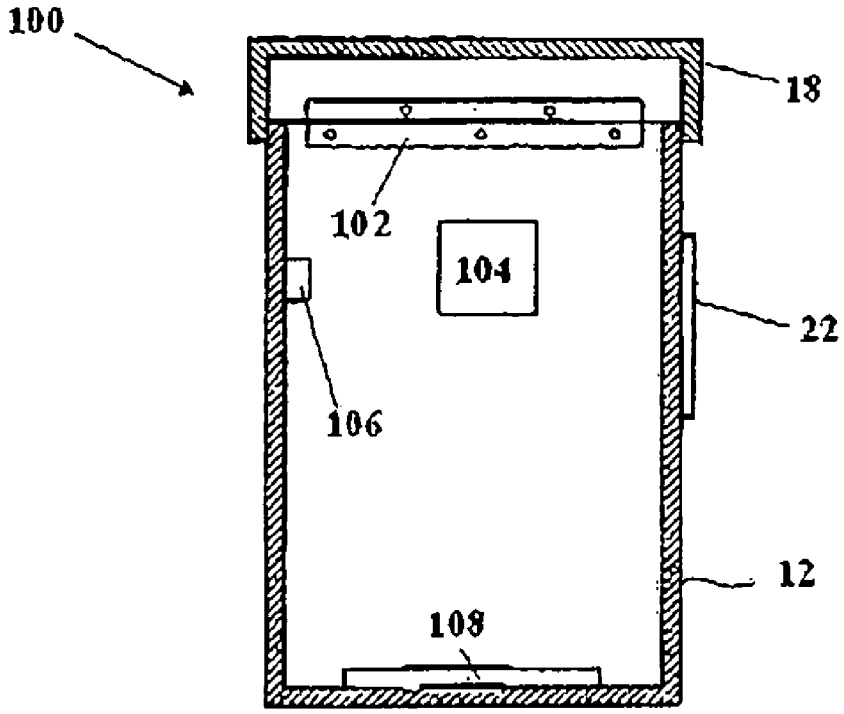
FIG. 2 shows a sectional view of the mailbox.

FIG. 2 shows a sectional view 100 of the mailbox 10 according to a preferred embodiment of the invention. This view shows the upper lid 18 hinges 102 for movably connecting the upper lid 18 with the box 12, a motion sensor 106 placed inwardly in the mailbox for sensing the motion, a keypad 22 for electronically locking and opening the door, a weight sensor 108 for sensing weight and a transmitter 104 for transmitting a signal to a remote indicator.

Figure 3:
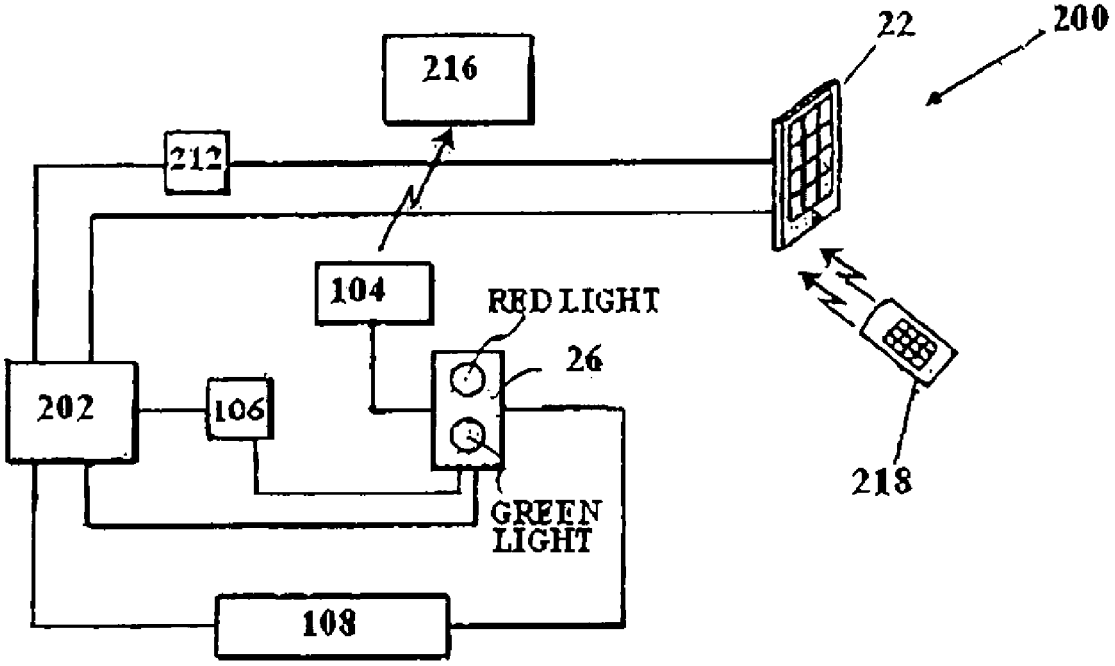
FIG. 3 shows a block diagram demonstrating circuitry according to a preferred embodiment of the invention.

FIG. 3 shows a block diagram 200 demonstrating circuitry according to a preferred embodiment of the invention. The circuitry has a power source 202 supplying power to motion sensor 106, weight sensor 108, transmitter 104 indicators 26 and electronic locking system having electromagnetic lock 212 and key pad 22. When mail is dropped from a postal slot the motion and the weight of the mail is sensed by the motion sensor 106 and weight sensor 108, and accordingly an indicator 26 is switched on/off. Further a signal is transmitted using transmitter 104 to a remotely located receiver 216 indicating a receipt of mail. The remote indicator may be provided with audio and visual indicators. Further the electronic lock and keypad may also be provided with the options for remote handing using the remote control 218.

FIG. 4 shows an upper lock of mailbox according to a preferred embodiment of the invention. The upper lid 18 is provided with the key-lock 302 and the body of the box is a projecting structure 306 jutting horizontally outwards. The key-lock 302 has latch 304 movably mounted to latch in the projecting structure 306 to lock the upper lid 18.

Figure 5:
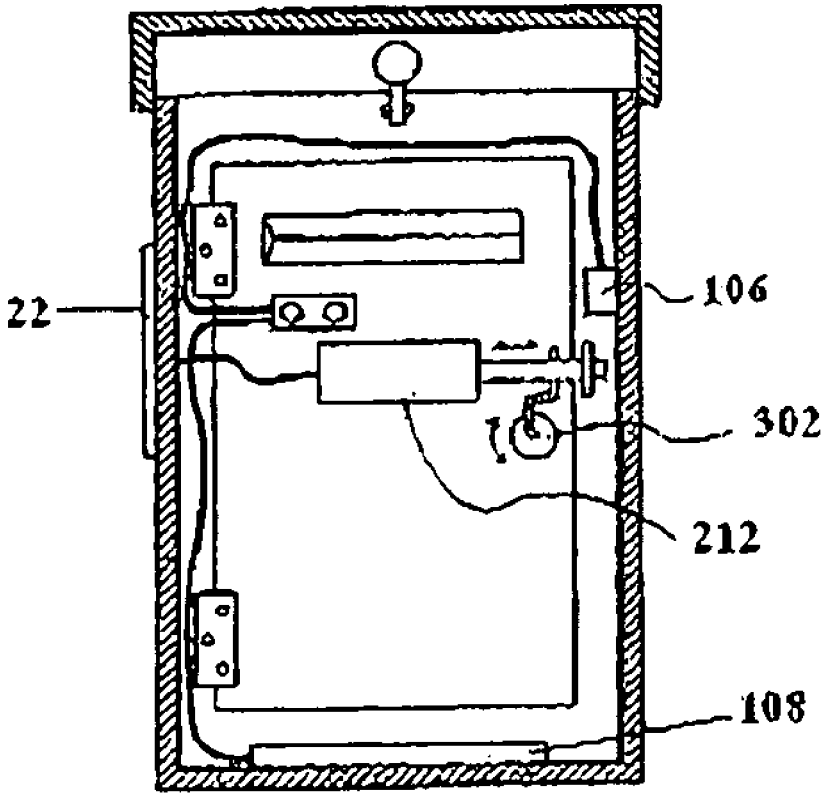
FIG. 5 shows a sectional view of the mailbox.

FIG. 5 shows a third view of the mailbox with wiring connections to different elements of the mailbox according to a preferred embodiment of the invention.

As used in this specification, the term "operably" is used to define both a wireless connection, and a wired connection.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

I claim:

1. A smart mailbox for receiving mail, comprising:

a base, a plurality of side walls secured to said base extending upwardly therefrom, a front panel mechanically attached to said base also extending upwardly from said base, said front panel having a front panel door and having a postal slot;

an upper lid secured to said side walls and said front panel;

said base, said plurality of walls, said front panel, and said upper lid defining a receptacle therein;

a sensor configured internally within said receptacle for detecting receipt of a mail;

an indicator placed on said front panel door, connected to said sensor for indicating receipt of a mail;

a first lock placed on said front panel door configured for locking and unlocking said front panel door to said front panel of said receptacle;

a second lock placed on said upper lid configured for locking and unlocking said upper lid to said front panel; and a keypad mounted on said receptacle connected to said first lock for operating locking and unlocking of said front panel door.

2. The smart mailbox of claim 1, wherein:

said sensor is a motion sensor.

3. The smart mailbox of claim 1, wherein:

said sensor is a weight sensor.

4. The smart mailbox of claim 1, wherein:

said indicator is a light/sound means disposed on the front panel door.

5. A smart mailbox as claimed in claim 1, wherein:

said indicator includes a local and a remote indicator.

6. A smart mailbox as claimed in claim 1 wherein:

said means for electronically locking is an electromagnetically operated lock and a keypad.

7. A smart mailbox as claimed in claim 1 wherein:

said keypad is remote keypad.

8. A smart mailbox as claimed in claim 1 wherein:

said mailbox is provided with a transceiver for remotely operating the electronic lock and remote indicators.

* * * * *